US007735820B2

(12) United States Patent
Ito

(10) Patent No.: US 7,735,820 B2
(45) Date of Patent: Jun. 15, 2010

(54) SHEET DELIVERY APPARATUS WITH SHEET EXTRACTION DEVICE

(75) Inventor: Reiji Ito, Ibaraki (JP)

(73) Assignee: Komori Corporation, Toyko (JP)

( * ) Notice: Subject to any disclaimer, the term of this patent is extended or adjusted under 35 U.S.C. 154(b) by 647 days.

(21) Appl. No.: 11/178,140

(22) Filed: Jul. 7, 2005

(65) Prior Publication Data

US 2006/0012111 A1 Jan. 19, 2006

(30) Foreign Application Priority Data

Jul. 8, 2004 (JP) ..... 2004-201785

(51) Int. Cl.
*B65H 29/68* (2006.01)

(52) U.S. Cl. ..... 271/69; 271/309; 271/280; 101/232

(58) Field of Classification Search ..... 271/69, 271/308, 309, 312, 280; 101/232
See application file for complete search history.

(56) References Cited

U.S. PATENT DOCUMENTS 2,406,936 A * 9/1946 Woodruff ..... 271/300
3,477,710 A 11/1969 Koch
2002/0035939 A1* 3/2002 Endo et al. ..... 101/480
2006/0011078 A1* 1/2006 Beitel et al. ..... 101/232

FOREIGN PATENT DOCUMENTS

| | | | |
|---|---|---|---|
| DE | 10222545 | | 11/2003 |
| GB | 1499200 | | 1/1978 |
| JP | 58-047749 | A | 3/1983 |
| JP | 59-179848 | U | 12/1984 |
| JP | 63-087469 | A | 4/1988 |
| JP | 11-334036 | A | 12/1999 |
| JP | 2000-062134 | A | 2/2000 |
| JP | 2001-151401 | A | 6/2001 |
| JP | 2002-348021 | A | 12/2002 |

* cited by examiner

*Primary Examiner*—Patrick Mackey
*Assistant Examiner*—Gerald W McClain
(74) *Attorney, Agent, or Firm*—Blakely, Sokoloff, Taylor & Zafman LLP

(57) ABSTRACT

A sheet delivery apparatus includes sprockets and delivery grippers, a sheet delivery device, a switching cam, and conveyor belt, driving roller, and driven roller. The sprockets and delivery grippers hold and convey a sheet. The sheet delivery device delivers the sheet conveyed by the sprockets and delivery grippers. The switching cam is arranged upstream of the sheet delivery device in a sheet convey direction to release the sheet held by the sprockets and delivery grippers. The conveyor belt, driving roller, and driven roller are arranged below the switching cam to convey the sheet released by the switching cam in the sheet convey direction.

14 Claims, 3 Drawing Sheets

SHEET DELIVERY APPARATUS WITH SHEET EXTRACTION DEVICE

BACKGROUND OF THE INVENTION

The present invention relates to a sheet delivery apparatus for extracting, from sheets printed by a printing unit in a sheet-fed offset rotary printing press and stacked on the pile board of a delivery device, every predetermined number of sheets as a printed sample or an inappropriate sheet which occurs at the start of printing or due to a printing registration error without stopping the printing press.

As shown in Japanese Patent Laid-Open No. 58-047749, a conventional sheet delivery apparatus includes a sheet loading device on which printing sheets are stacked, a delivered sheet receiver for a printed sample which is arranged downstream of the sheet loading device in the sheet convey direction, a switching cam arranged above the sheet loading device, and a fixing cam arranged above the delivered sheet receiver. In this structure, the switching cam is retreated from the traveling path of a delivery pawl by switching. When the traveling delivery pawl abuts against the fixing cam, it releases the sheet. The sheet is delivered not onto the sheet loading device but onto the delivered sheet receiver.

As shown in Japanese Patent Laid-Open No. 2000-62134, a sheet delivery apparatus is proposed which includes a pile board on which a sheet gripped by a sheet delivery pawl and conveyed by the travel of a delivery chain is to be stacked, and a receiving plate for a delivered sample sheet which is arranged most downstream in the sheet delivery chain. As shown in Japanese Patent Laid-Open No. 63-87469, a sheet delivery apparatus is proposed which includes a lay which is set upright or laid down by a handle operation and aligns the leading edge of a sheet stacked on a board receiving plate when it is set upright, and a sheet receiver which is interlocked with the laying operation of the lay to enter a sheet falling passage in order to regulate falling of the sheet onto the board receiving plate and receive the sheet. In this structure, while the sheet receiver receives a sheet, one of the sheets stacked on the board receiving plate is extracted as a printed sample.

Of the three conventional sheet delivery apparatuses described above, in the first and second apparatuses, the delivered sheet receiver or receiving plate for the sample sheet is arranged downstream of the sheet loading device in the sheet convey direction. Thus, the sheet which is to be delivered to the delivered sheet receiver or receiving plate passes above the sheet loading device. At this time, if the trailing edge of the sheet hangs due to the instability of the sheet or waving, the hanging trailing edge comes into slidable contact with the surface of the upper most one of the sheets stacked on the sheet loading device to damage the surface of the sheet, thus causing wasted paper. In the third apparatus described above, when a printed sample is to be extracted, it comes into slidable contact with the upper surface of the sheet immediately under it to damage the upper surface of the sheet, thus causing wasted paper.

SUMMARY OF THE INVENTION

It is an object of the present invention to provide a sheet delivery apparatus in which, when a sheet is to be extracted as a printed sample or the like, the sample is prevented from damaging the upper surface of the sheet left on a sheet delivery means, thus preventing wasted paper.

In order to achieve the above object, according to the present invention, there is provided a sheet delivery apparatus comprising first convey means for holding and conveying a sheet, sheet delivery means for delivering the sheet conveyed by the first convey means, releasing means, arranged upstream of the sheet delivery means in a sheet convey direction, for releasing the sheet held by the first convey means, and second convey means, arranged below the releasing means, for conveying the sheet released by the releasing means in the sheet convey direction.

DESCRIPTION OF THE PREFERRED EMBODIMENTS

Figure 1:
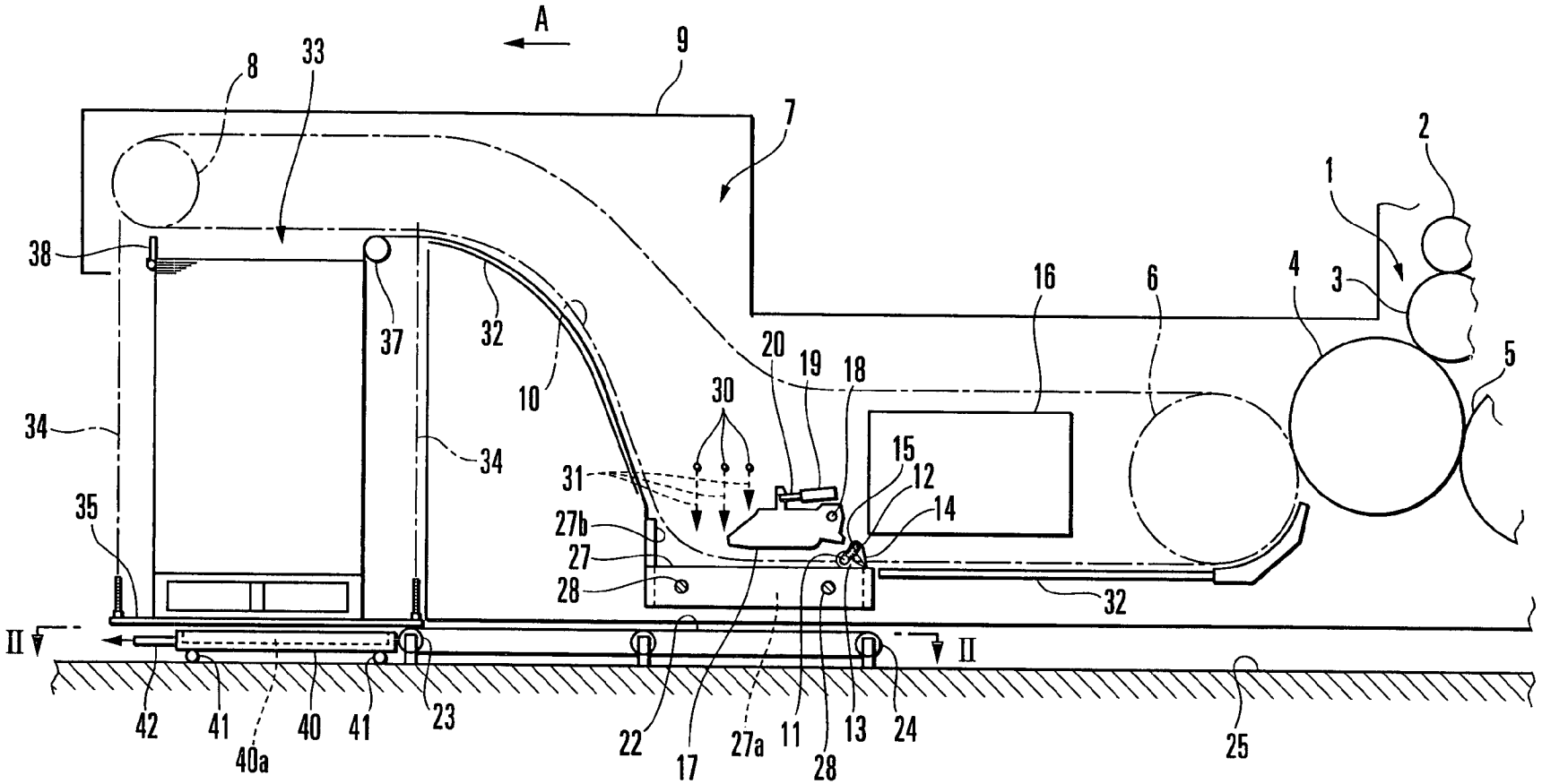
FIG. 1 is a side view of a sheet delivery apparatus in a sheet-fed offset rotary printing press according to the first embodiment of the present invention.
Figure 2:
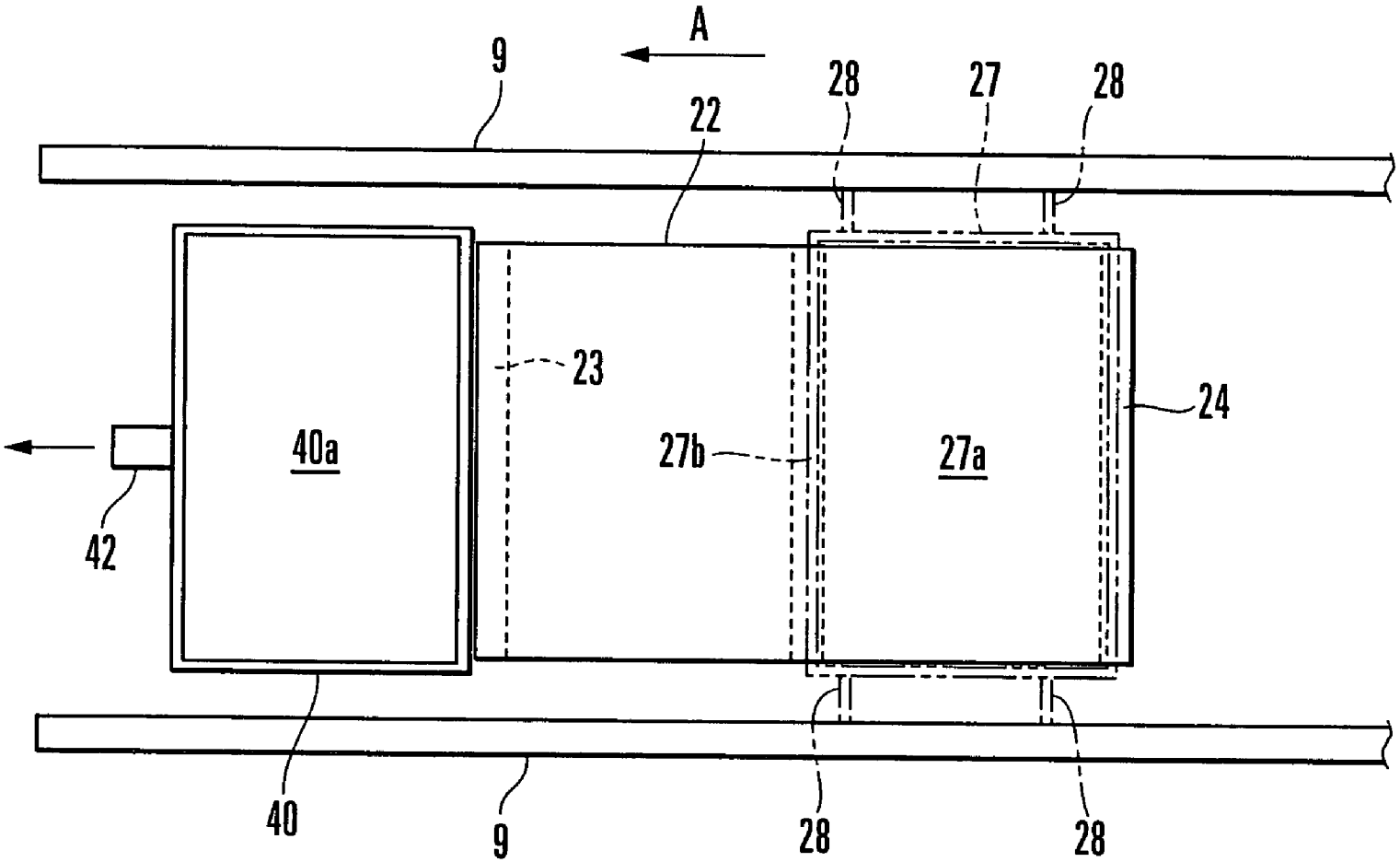
FIG. 2 is a sectional view seen from the arrows of the line II-II of FIG. 1.

A sheet delivery apparatus according to the first embodiment of the present invention will be described with reference to FIGS. 1 and 2. Referring to FIG. 1, a printing unit 1 includes a plate cylinder 2 with an outer surface where a plate is mounted, a blanket cylinder 3 in contact with the plate cylinder 2, and an impression cylinder 4 in contact with the blanket cylinder 3 and an upstream transfer cylinder 5.

The impression cylinder 4 is in contact with a delivery cylinder (not shown). A pair of delivery chains 10 (one delivery chain is not shown) extend between a sprocket 6 provided coaxially with the delivery cylinder and a sprocket 8 provided at the terminal end of a delivery unit 7 along a pair of opposing delivery frames 9. A plurality of pairs each comprising a gripper shaft 11 and gripper pad shaft 12 are supported between the pair of delivery chains 10 at predetermined intervals in the traveling direction of the delivery chains 10. A plurality of delivery grippers 13 (first convey means) and gripper pads 14 line up to oppose each other on the gripper shaft 11 and gripper pad shaft 12, respectively, between the pair of delivery chains 10. A sheet which is gripping-changed from the gripper device (not shown) of the impression cylinder 4 is gripped by the opposing delivery grippers 13 and gripper pads 14 and conveyed in a direction of an arrow A as the delivery chains 10 travel.

A dryer 16 dries the printed surface of the sheet which is printed by the printing unit 1 and gripped and conveyed by the delivery grippers 13 and gripper pads 14. A switching cam 17 (releasing means) is arranged upstream (opposite to the arrow A) of a sheet delivery device 33 (to be described later) in the sheet convey direction. One end of the switching cam 17 is pivotally, axially supported by the delivery frames 9 through a shaft 18, and a rod 20 of a pneumatic cylinder 19 is pivotally mounted on the upper central portion of the switching cam 17. The cylinder end of the pneumatic cylinder 19 is pivotally supported by the delivery frames 9, and the rod 20 moves forward/backward in the sheet convey direction.

When the rod 20 of the pneumatic cylinder 19 moves backward, the switching cam 17 pivots clockwise in FIG. 1 about the shaft 18 as the center to retreat from the traveling path of the delivery grippers 13 (retreat state). When the rod 20 moves forward, the switching cam 17 pivots counterclockwise in FIG. 1 about the shaft 18 as the center to enter the traveling path of the delivery grippers 13 (operative state). In the operative state, cam followers 15 of the traveling delivery grippers 13 abut against the switching cam 17 to release the sheet gripped by the delivery grippers 13.

A conveyor belt 22 (second convey means) is arranged below the central portion of the pair of delivery chains 10. The conveyor belt 22 is applied to extend along a floor 25 between a driving roller 23 and driven roller 24. On the upstream side in the sheet convey direction, the conveyor belt 22 is positioned below the switching cam 17. On the downstream side in the sheet convey direction, the conveyor belt 22 extends down to a position where it is close to the lower portion of the sheet delivery device 33.

The driving roller 23 is rotated by a motor (not shown) counterclockwise in FIG. 1 so that the conveyor belt 22 travels in the sheet convey direction (the direction of the arrow A). A sheet which is released from the delivery grippers 13 by the switching cam 17 to drop down with its own weight is placed on the conveyor belt 22. The placed sheet is conveyed in the direction of the arrow A toward the sheet delivery device 33 (to be described later).

Between the switching cam 17 and conveyor belt 22, a guide member 27 is horizontally attached to the pair of delivery frames 9 through stays 28. The guide member 27 forms a rectangular frame (rectangular short cylinder) with upper and lower openings, and its inner surface forms a guide hole 27*a*. The size of the guide hole 27*a* is set to be slightly larger than the outer shape of a maximum-size sheet. A lay 27*b* which regulates the dropping sheet from moving in the sheet convey direction (direction of the arrow A) stands upright above the downstream end in the sheet convey direction (direction of the arrow A) of the guide member 27. The guide member 27 guides onto the conveyor belt 22 the sheet which is dropping down as it is released from the delivery grippers 13 by the switching cam 17.

Air nozzles 30 which are connected to a discharge pump (not shown) through a valve blow out air 31 downward to guide the sheet, which drops along the lay 27*b* of the guide member 27, to the guide hole 27*a* of the guide member 27. Under the delivery chains 10, a sheet guide plate 32 is arranged along the traveling path.

The sheet delivery device 33 is arranged at the terminal end of the traveling path of the delivery chains 10. The sheet delivery device 33 includes a sheet pile plate 35, pile board 36, suction wheel 37, and lay 38. The sheet pile plate 35 is suspended by hoist chains 34 to be vertically movable. The pile board 36 is placed on the sheet pile plate 35 and stacks sheets on it. The suction wheel 37 regulates the instability of the sheet which is gripped and conveyed by the delivery grippers 13. The lay 38 aligns the leading edge of the sheet which is released from the delivery grippers 13 and drops onto the pile board 36.

In this structure, while the sheet which is gripped by the delivery grippers 13 and conveyed, as the delivery chains 10 travel, is drawn by the suction wheel 37, the cam followers 15 of the delivery grippers 13 abut against the fixing cam (not shown). Thus, the sheet is released from the delivery grippers 13. The leading edge of the released sheet is aligned by the lay 38, and the sheet is stacked on the pile board 36.

A flat rectangular parallelepiped (thick rectangular plate-like) sheet receiving member 40 is arranged below the sheet delivery device 33. A recess 40*a* having an inner size larger than the outer shape of the maximum-size sheet is formed in the upper surface of the sheet receiving member 40. A handle 42 is attached to the outer surface, downstream in the sheet convey direction (direction of the arrow A), of the sheet receiving member 40. The sheet receiving member 40 is supported by rollers 41 provided to its lower surface, so that it can move on the floor 25. The operator holds the handle 42 and moves the sheet receiving member 40. The sheet receiving member 40 moves in a direction opposite to the sheet convey direction (direction of the arrow A) below the sheet delivery device 33 and is positioned close to the conveyor belt 22. Thus, the sheet which is conveyed by the conveyor belt 22 is received in the recess 40*a*.

The sheet delivery operation of the sheet delivery apparatus having the above arrangement will be described. In the initial state, the rod 20 of the pneumatic cylinder 19 moves backward, and the switching cam 17 retreats from the traveling path of the delivery chains 10. The valve of the air nozzles 30 is closed to stop air supply to the air nozzles 30. The motor which drives the driving roller 23 is stopped to stop traveling of the conveyor belt 22.

When printing is started, the sheet which has passed between the blanket cylinder 3 and impression cylinder 4 of the printing unit 1 and is printed on its upper surface is gripping-changed from the gripper device of the impression cylinder 4 to the delivery grippers 13 of the delivery chains 10, and is conveyed by the delivery chains 10 in the sheet convey direction (direction of the arrow A). When the sheet is conveyed to the sheet delivery device 33, the cam followers 15 of the delivery grippers 13 abut against the fixing cam (not shown) to release the sheet from the delivery grippers 13. The leading edge of the released sheet is aligned by the lay 38, and the sheet is stacked on the pile board 36.

When a printed sample is to be extracted, a change-over switch (not shown) is turned on. Then, the rod 20 of the pneumatic cylinder 19 moves forward, and the switching cam 17 advances to the traveling path of the delivery grippers 13. Interlocked with this releasing operation, the valve of the air nozzles 30 is opened, and the air 31 is blown from the air nozzles 30. Simultaneously, the motor of the driving roller 23 is driven, and the conveyor belt 22 travels in the sheet convey direction (direction of the arrow A). In this state, the sheet is gripping-changed from the gripper device of the impression cylinder 4 to the delivery grippers 13 of the delivery chains 10 and conveyed in the direction of the arrow A by the delivery chains 10. The cam followers 15 of the delivery grippers 13 abut against the switching cam 17. Thus, the sheet which is released from the delivery grippers 13 is regulated by the lay 27*b* of the guide member 27 from moving in the sheet convey direction (direction of the arrow A), and drops down with its own weight.

At this time, since the air 31 is blown downward from the air nozzles 30, the sheet reliably drops down with its own weight and by the operation of the air 31, and is guided to the guide hole 27*a* of the guide member 27. The sheet which is released from the delivery grippers 13 and drops down passes through the guide hole 27*a* of the guide member 27, and is reliably guided to and placed on the conveyor belt 22.

The sheet placed on the conveyor belt 22 is conveyed in the sheet convey direction (direction of the arrow A) as the conveyor belt 22 travels, and transferred to the recess 40*a* in the sheet receiving member 40 at the end of the conveyor belt 22. When a predetermined number of sheets are transferred to the sheet receiving member 40, the change-over switch is turned off. Then, the rod 20 of the pneumatic cylinder 19 moves backward to retreat the switching cam 17 from the traveling path of the delivery chains 10. The valve of the air nozzles 30 is closed to stop air supply to the air nozzles 30. The motor of the driving roller 23 is also stopped, and traveling of the conveyor belt 22 is stopped.

Then, the operator holds the handle 42 and moves the sheet receiving member 40 in the sheet convey direction (direction of the arrow A). The sheet receiving member 40 is pulled out from under the sheet delivery device 33, and a sheet as a printed sample is extracted from the recess 40*a* of the sheet receiving member 40.

According to this embodiment, the sheet is released from the delivery grippers 13 and extracted on the upstream side of the sheet delivery device 33 in the sheet convey direction. Therefore, the extracted sheet will not come into slidable contact with the upper surface of the sheet stacked on the pile board 36, and its upper surface will not be damaged. Thus, wasted paper can be prevented. Since the sheet receiving member 40 is arranged below the sheet delivery device 33, it will not project outside the sheet delivery device 33, so that the space can be decreased. The sheet can be extracted from the sheet receiving member 40 while the sheet receiving member 40 is moved from under the sheet delivery device 33 to outside the printing press. Thus, the workability is improved.

A sheet delivery apparatus in a sheet-fed offset rotary printing press according to the second embodiment of the present invention will be described with reference to FIG. 3. According to the characteristic feature of this embodiment, when the entire length of delivery chains 10 is small and a space to arrange a switching cam is not provided, a switching cam 50 is arranged in a sprocket 6 which is coaxial with a delivery cylinder. More specifically, the switching cam 50 is attached in the sprocket 6 to extend along that outer surface of the sprocket 6 which corresponds to the engaging portion of the delivery chains 10 and sprocket 6. One end of the switching cam 50 is pivotally supported by delivery frames 9 through a shaft 51. A rod 53 of a pneumatic cylinder 52 is pivotally mounted on the upper central portion of the switching cam 50. The cylinder end of the pneumatic cylinder 52 is pivotally supported so that the rod 53 moves forward/backward in the up-to-down direction (vertical direction). When the rod 53 of the pneumatic cylinder 52 moves backward, the switching cam 50 pivots clockwise in FIG. 3 about the shaft 51 as the center, to retreat from the traveling path of delivery grippers 13.

Figure 3:
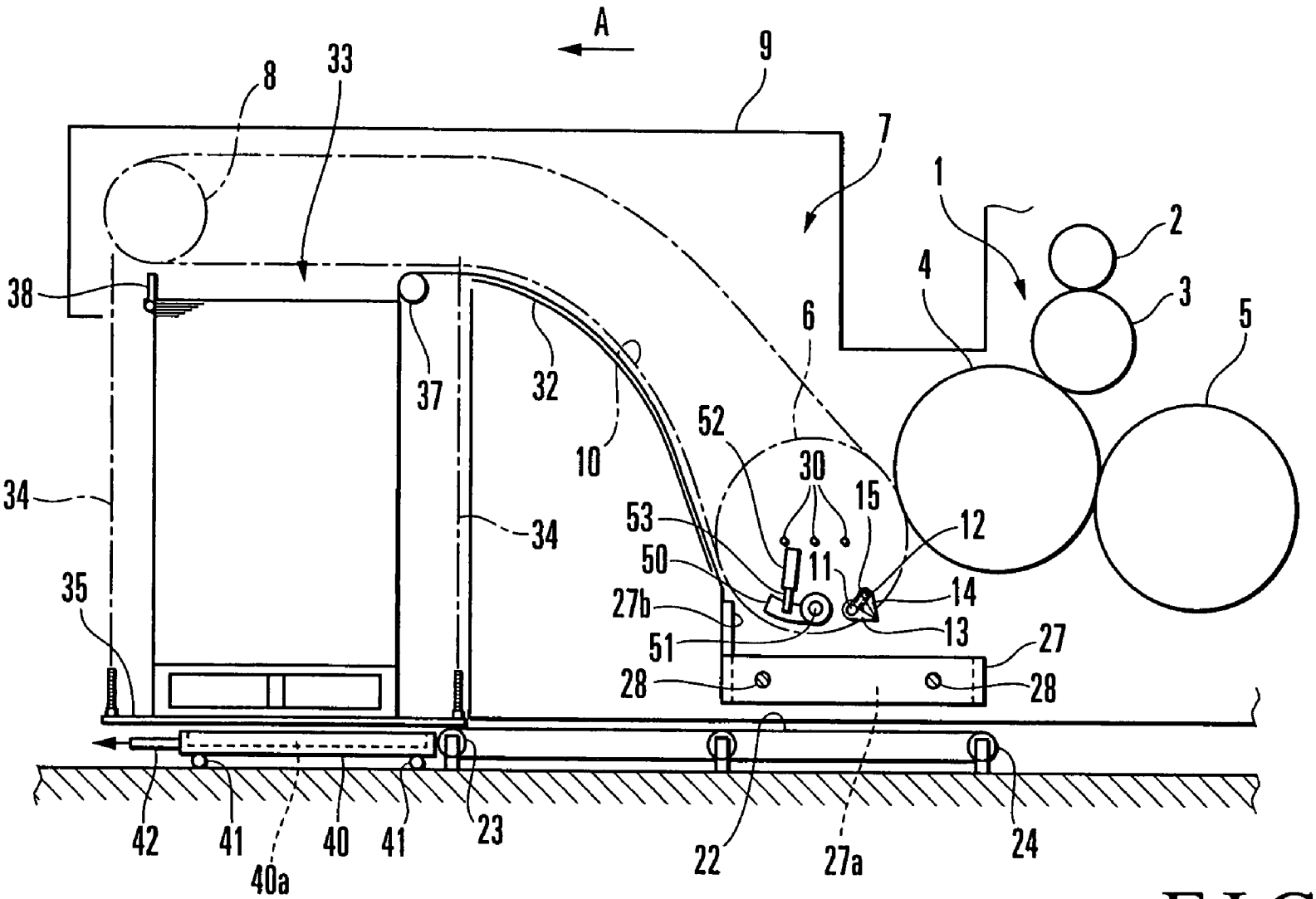
FIG. 3 is a side view of a sheet delivery apparatus in a sheet-fed offset rotary printing press according to the second embodiment of the present invention.

When the rod 53 moves forward, the switching cam 50 pivots counterclockwise in FIG. 3 about the shaft 51 as the center, to advance to the traveling path of the delivery grippers 13. Thus, cam followers 15 of the traveling delivery grippers 13 abut against the switching cam 50 to release the sheet from the delivery grippers 13. The released sheet is regulated by a lay 27*b* of a guide member 27 from moving in the sheet convey direction (direction of an arrow A), and is guided to a guide hole 27*a* in the guide member 27 by its own weight and air blown from air nozzles 30. The sheet passing through the guide hole 27*a* is placed on a conveyor belt 22. The sheet placed on the conveyor belt 22 is conveyed by the conveyor belt 22 in the sheet convey direction (direction of the arrow A) and transferred to a sheet receiving member 40.

In the above embodiments, the sheet receiving member 40 is moved in the sheet convey direction (direction of the arrow A) and pulled out from under the sheet delivery device 33. Alternatively, the sheet receiving member 40 may be moved in a direction perpendicular to the sheet convey direction (direction of the arrow A), i.e., in the transversal direction of the sheet delivery device 33. The sheet receiving member 40 is arranged below the sheet delivery device 33. Alternatively, the sheet receiving member 40 may be attached to the conveyor belt 22, and be movable between below the switching cam 17 and below the sheet delivery device 33. Although the sheet receiving member 40 is provided, the conveyor belt 22 may be extended below the sheet delivery device 33 or longer than that. In this case, the sheet receiving member 40 need not be provided.

The present invention is applied to a sheet. The present invention can also be applied to a film such as a polyvinyl chloride sheet or a sheet-type object formed of an aluminum plate. The guide member 27 includes the guide hole 27*a* and lay 27*b*. Alternatively, only the lay 27*b* may be provided so the sheet-type object which is released from the delivery grippers 13 reliably drops onto the conveyor belt 22.

As has been described above, according to the present invention, the sheet is extracted on the upstream side of the sheet delivery means in the sheet convey direction. The surface of the sheet delivered to the sheet delivery means will not be damaged, and wasted paper can be prevented. As the sheet receiving member is arranged under the sheet delivery means and does not project outside it, the space can be decreased.

The sheet can be extracted from the sheet receiving means while the sheet receiving means has been moved outside the printing press from below the sheet delivery means. This improves workability. The sheet which is released by the releasing means can be reliably guided to the second convey means by the guide means. Also, the sheet released by the releasing means can be reliably guided to the guide means by the air blowing means.

What is claimed is:

1. A sheet delivery apparatus comprising:

first convey means for holding and conveying a sheet;

sheet delivery device for delivering the sheet conveyed by said first convey means;

releasing means, arranged upstream of said sheet delivery device in a sheet convey direction, for releasing the sheet, held by said first convey means, onto a second conveying means by gravity, wherein the sheet delivery device has a sheet pile plate on which the sheet conveyed and released by the first convey means is stacked; and said second convey means, arranged directly below said releasing means, for conveying the sheet released by said releasing means in the sheet convey direction, wherein the second convey means conveys the sheet directly below said sheet pile plate.

2. An apparatus according to claim 1, further comprising a sheet receiving member which is arranged below said sheet delivery device to receive the sheet conveyed by said second convey means.

3. An apparatus according to claim 2, wherein said sheet receiving member has a recess, having an inner shape larger than an outer shape of a maximum-size sheet, in an upper surface thereof.

4. An apparatus according to claim 2, wherein said sheet receiving member is supported to be movable below said sheet delivery device.

5. An apparatus according to claim 4, wherein said sheet receiving member moves in the sheet convey direction.

6. An apparatus according to claim 5, wherein said sheet receiving member includes a handle attached to an outer surface which is on a downstream side in the sheet convey direction, and a plurality of rollers which are attached to a lower surface of said sheet receiving member and rotated by a force applied to said handle to move said sheet receiving member.

7. An apparatus according to claim 1, further comprising a guide member for guiding the sheet, which is released by said releasing means, to said second convey means.

8. An apparatus according to claim 7, further comprising air blowing means for guiding the sheet, which is released by said releasing means, to said second convey means by air.

9. An apparatus according to claim 8, wherein air blowing operation of said air blowing means is started interlocked with operation of said releasing means.

10. An apparatus according to claim 7, wherein said guide member includes a lay member which is arranged at an end of said guide member on a downstream side in the sheet convey direction and regulates the sheet, which is released by said releasing means, from moving in the sheet convey direction.

11. An apparatus according to claim 7, wherein said guide member includes a guide hole which forms a rectangular frame with upper and lower openings and has an inner surface which is set slightly larger than an outer shape of a maximum-size sheet.

12. An apparatus according to claim 1, wherein said first convey means includes a pair of sprockets and a delivery chain extended between said pair of sprockets, and said releasing means is arranged in said sprocket which is on an upstream side in the sheet convey direction to correspond to an engaging portion of said delivery chain and sprocket.

13. An apparatus according to claim 1, wherein said second convey means includes a conveyor belt extended between a pair of rollers which are arranged at a predetermined distance from each other in the sheet convey direction.

14. A sheet delivery apparatus with a sheet extraction device, comprising:

a delivery gripper for holding and conveying a sheet;

a sheet delivery device into which the sheet conveyed by said delivery gripper is discharged, wherein the sheet delivery device has a sheet pile plate on which the sheet conveyed and discharged by the delivery gripper is stacked;

a switching cam which is disposed upstream of said sheet delivery device in the sheet convey direction for releasing the sheet held by said delivery gripper; and a conveyor belt which is disposed directly under said switching cam for placing thereon the sheet dropping down from said delivery gripper after being released by said switching cam to convey the sheet in the convey direction, wherein the conveyor belt conveys the sheet directly below said sheet pile plate.

* * * * *

UNITED STATES PATENT AND TRADEMARK OFFICE

CERTIFICATE OF CORRECTION

PATENT NO. : 7,735,820 B2
APPLICATION NO. : 11/178140
DATED : June 15, 2010
INVENTOR(S) : Ito It is certified that error appears in the above-identified patent and that said Letters Patent is hereby corrected as shown below:

Title Page, Item (73) Assignee: delete "Toyko" insert -- Tokyo --

Signed and Sealed this
Twenty-second Day of March, 2011

David J. Kappos

David J. Kappos
*Director of the United States Patent and Trademark Office*